US008109045B2

(12) United States Patent
Kliefoth et al.

(10) Patent No.: US 8,109,045 B2
(45) Date of Patent: Feb. 7, 2012

(54) FORM DRAIN FOR INCORPORATION INTO A BUILDING FOUNDATION

(75) Inventors: Christopher Kliefoth, Tampa, FL (US); E. Erik Timothy, Apollo Beach, FL (US)

(73) Assignee: Nationwide Industries, Inc., Tampa, FL (US)

( * ) Notice: Subject to any disclaimer, the term of this patent is extended or adjusted under 35 U.S.C. 154(b) by 1450 days.

(21) Appl. No.: 11/379,425

(22) Filed: Apr. 20, 2006

(65) Prior Publication Data

US 2006/0239781 A1 Oct. 26, 2006

Related U.S. Application Data

(60) Provisional application No. 60/594,623, filed on Apr. 25, 2005.

(51) Int. Cl.
*E02D 19/00* (2006.01)
*E04B 1/70* (2006.01)
*E02B 11/00* (2006.01)

(52) U.S. Cl. ..... 52/169.5; 52/302.4; 405/45

(58) Field of Classification Search ..... 249/2, 3, 249/4, 5, 6, 7, 34, 208, 210, 213, 216; 52/169.5, 52/302.1, 302.3, 302.4, 900, 604, 605, 607; 454/287; 405/44, 45
See application file for complete search history.

(56) References Cited

U.S. PATENT DOCUMENTS

| | | | | | |
|---|---|---|---|---|---|
| 1,320,647 | A | * | 11/1919 | Pomerantz | 52/428 |
| 1,746,816 | A | * | 2/1930 | Boes | 52/302.4 |
| 2,316,319 | A | * | 4/1943 | Demarest | 138/115 |
| 2,329,585 | A | * | 9/1943 | Brewer | 52/302.4 |
| 3,391,507 | A | * | 7/1968 | Downing | 52/314 |
| 3,613,323 | A | * | 10/1971 | Hreha | 52/169.5 |
| 4,202,145 | A | * | 5/1980 | Coulter et al. | 249/3 |
| 4,551,870 | A | * | 11/1985 | Presti, Jr. | 4/613 |
| 5,224,799 | A | * | 7/1993 | Parker | 405/229 |
| 5,586,416 | A | * | 12/1996 | Hess et al. | 52/169.5 |

* cited by examiner

*Primary Examiner* — Michael Safavi
(74) *Attorney, Agent, or Firm* — George R. McGuire; Blaine T. Bettinger; Bond Schoeneck & King

(57) ABSTRACT

An improved building foundation form system that includes an integral drain and a spacer bar with engagement lugs at each end adapted to engage a T-shaped engagement channel formed in each of the form surfaces of the inner and outer forms.

10 Claims, 3 Drawing Sheets

FORM DRAIN FOR INCORPORATION INTO A BUILDING FOUNDATION

PRIORITY CLAIM

This application claims priority to U.S. Provisional Patent Application 60/594,623, filed Apr. 25, 2005.

BACKGROUND OF THE INVENTION

The instant invention relates to forms for building foundations wherein the form structures include drain means to accept and channel excess ground water away from the foundation. More specifically, the instant invention provides a building foundation form with an integral drain channel that is easily assembled and provides convenient means for fixing the width of the foundation.

It is known to construct a form for a concrete foundation out of solid material, such as wood planks, which is removed after the foundation material solidifies. Such foundation construction is time consuming in that it requires removal of the forms once the foundation material has sufficiently cured. Such constructions also require the installation of drains around the foundation perimeter to remove ground water from the foundation base, thereby preventing moisture seepage and material degradation of the foundation.

It is also known to provide perforated form components that remain in position after the foundation material solidifies and that provide a drainage channel for excess ground water. Examples of these types of forms can be readily seen in U.S. Pat. Nos. 5,120,162; 5,224,799; 5,474,400; and 5,466,092, and it is this type of form drain with which the present invention is most closely related.

The state of the art in integral form drains include extruded or otherwise manufactured lengths of hollow form members, wherein the interior face defining the form is smooth and the opposing exterior surface includes foramens formed therethrough. The upper and bottom surfaces of these forms are, like the interior facing surface, non-foraminous and smooth. A series of brackets are taught in the prior art, for example the '799 patent, for separating an inner drain form from an exterior drain form.

While the prior art is effective at forming a contained foundation system and at draining ground water that rises above the bottom of the form away from the foundation, improvements relating to the level at which ground water is contained and in the structural integrity of the system as a whole are desirable.

It is therefore a principal object and advantage of the present invention to provide a building foundation form and drain with high structural integrity.

It is another object and advantage of the present invention to provide a building foundation form that drains ground water away from the foundation as soon as it reaches the bottom of the foundation.

It is another object and advantage of the present invention to provide a building foundation form drain system that is easily installed.

Other objects and advantages of the present invention will in part be obvious and in part appear hereinafter.

SUMMARY OF THE INVENTION

In accordance with the foregoing objects and advantages, the present invention provides hollow form material that has perforations/foramens on two sides thereof and which contains an interior channel for directing the flow of water. The present invention also provides a form spacing device that selectively and securely engages an exterior channel formed on the form that securely interconnects and fixes the lateral distance between two facing forms.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
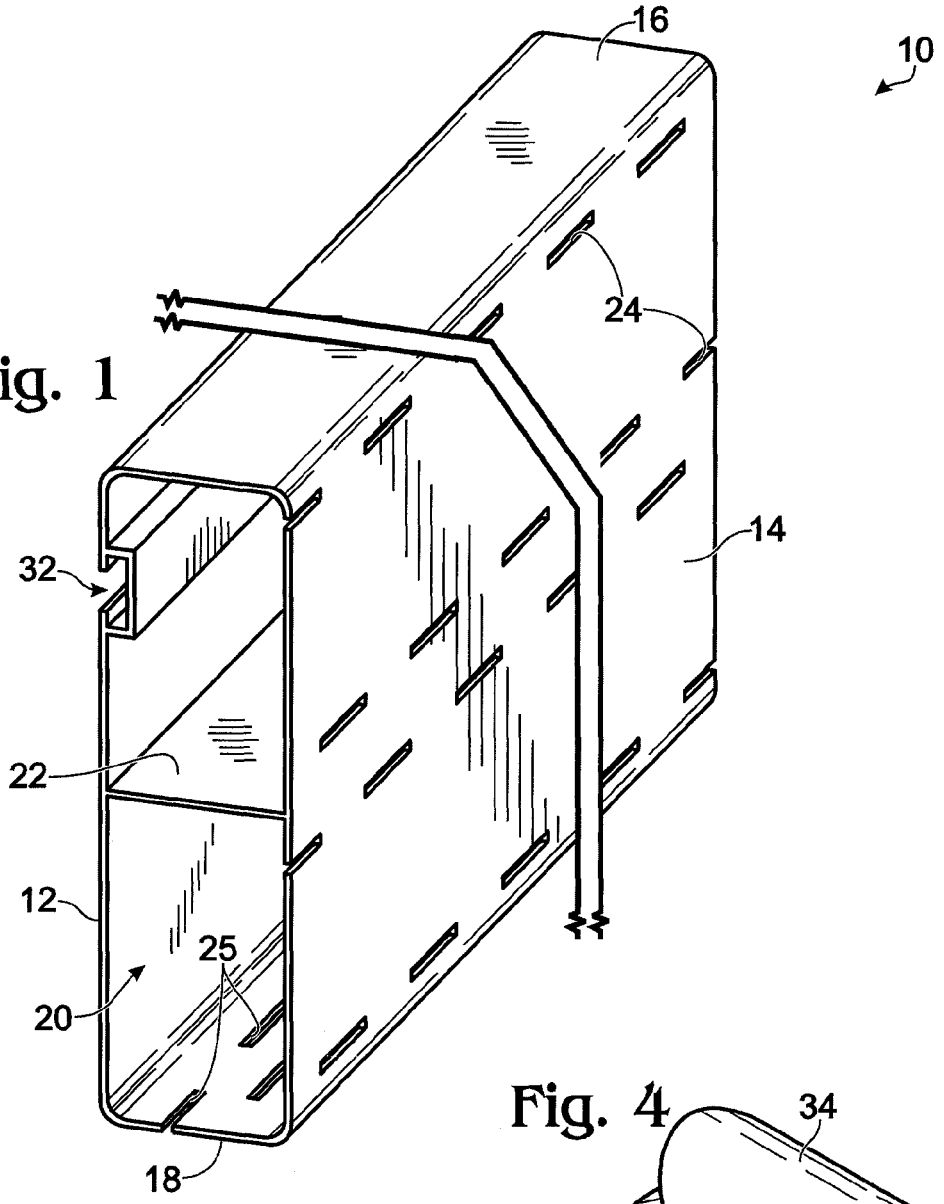
FIG. 1 is a perspective view of a form-drain segment according to an embodiment of the invention.
Figure 4:
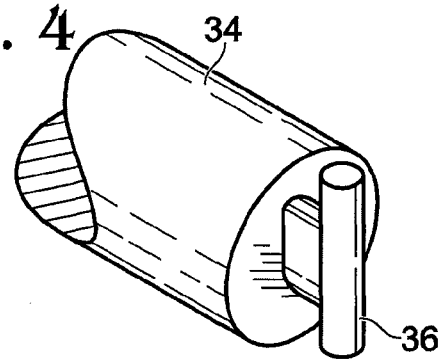
FIG. 4 is a partial perspective view of an engagement fitting on an end of a form spacing device.
Figure 3:
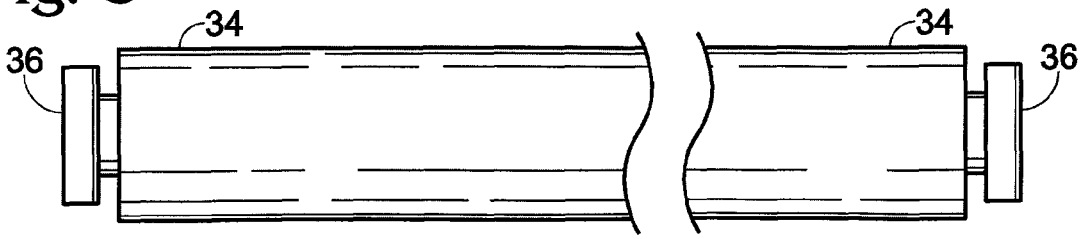
FIG. 3 is a side elevation view of a form spacing device for use with form drain segments according to an embodiment of the invention.

Referring now to the figures wherein like reference numerals refer to like parts throughout, there is seen in FIG. 1 a form-drain segment 10. Form-drain segment 10 has a form face 12, a drain face 14, a top surface 16 and a bottom surface 18. Together the form face 12, drain face 14, top surface 16 and bottom surface 18 define an interior channel 20.

Form-drain segment 10 may also have one or more stiffening members 22 extending the length of segment 10 and between form face 12 and drain face 14, thereby increasing the rigidity of segment 10 and helping prevent a form drain segment 10 from deforming substantially under the pressure applied when the foundation material is introduced into a form or when the foundation and drain are backfilled with gravel and/or soil. Preferably, stiffening member 22 is parallel to and approximately equidistant between top surface 16 and bottom surface 18, subdividing interior channel 20, although this spacing could be other than equidistant depending on the particular application. Stiffening member 22 may be solid or perforated, although if segment 10 is extruded as a single piece, it would be difficult to perforate.

According to the present invention, drain face 14 includes a plurality of drain perforations/foramens 24. Preferably, bottom surface 18 also includes a plurality of drain perforations/foramens 25. Drain perforations 24 and 25 are sized to permit excess water to enter the interior channel 20 as soon as it rises to the level of bottom surface 18, but prevents gravel or other larger granular sized solid material from entering the internal channel 20. A filter cloth (not shown) could also be used top prevent the infiltration of debris.

Form drain segment 10 can be constructed in a variety of heights, widths and lengths to accommodate different foundation construction requirements. In addition to linear portions of form drain segment 10, form drain segment 10 can be constructed or interconnected in an angular shape (e.g., 90 degree interior angle, or 45 degree exterior angle) or a curved shape (e.g., 12 inch radius exterior curve) to accommodate the construction requirements for a variety of foundation shapes.

Figure 2:
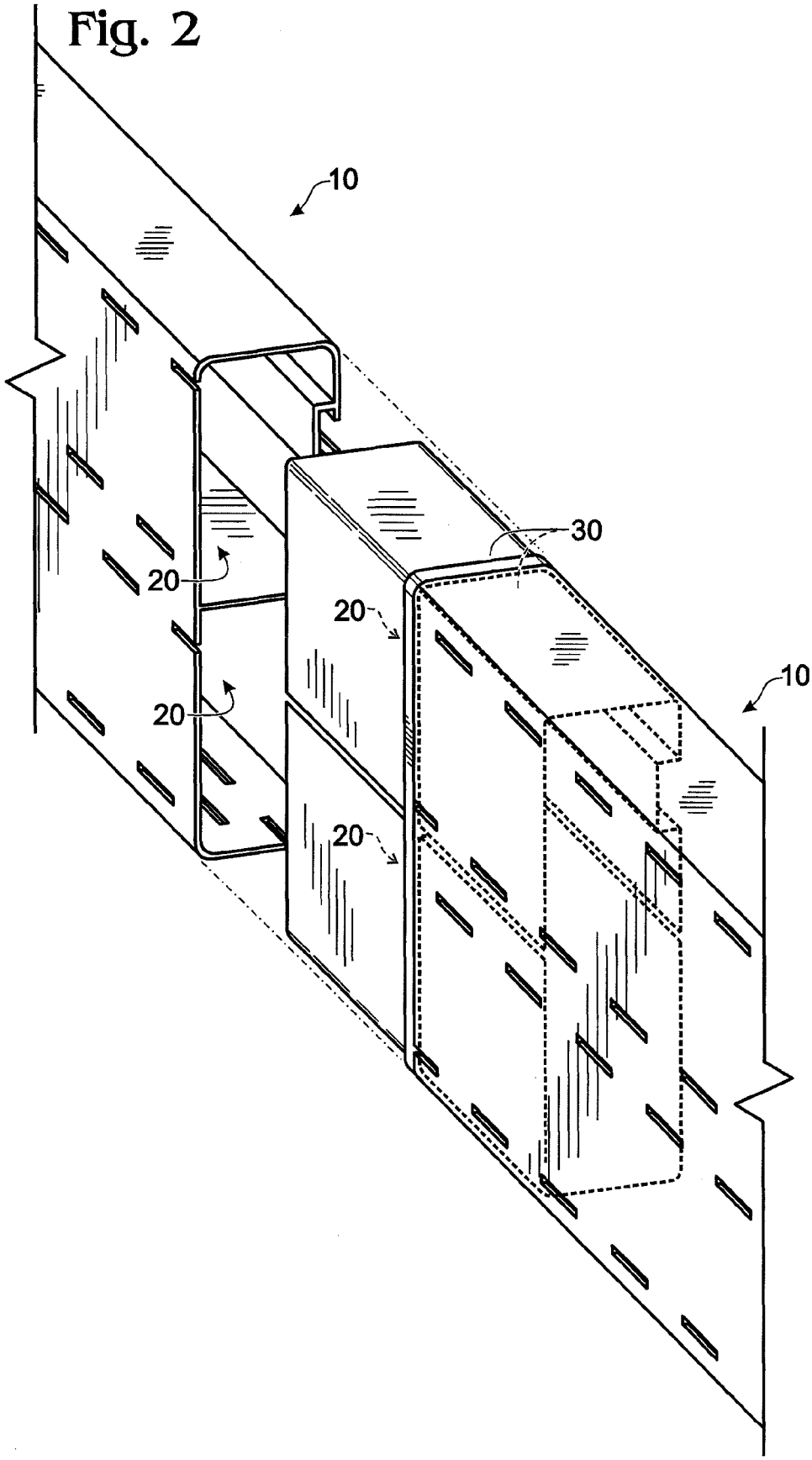
FIG. 2 is a perspective view of an exemplary connector used for interconnecting two adjacent form drain segments.

Each form drain segment 10 can be connected to another form drain segment 10. According to one embodiment shown in FIG. 2, individual form drain segments 10 are connected to each other using a female/female form drain connector 30 that fits snugly within channel 20 of two adjacent form drain segments 10. Alternatively, connector 30 could be of the male/male type with both ends fitting snugly over adjacent segments 10, or female/male type with one end fitting within and the opposite end fitting over adjacent segments 10. Further, connector 30 can be angularly shaped (90 degrees, 45 degrees, etc.) or curved, for example, to interconnect two adjacent segments 10 in a manner other than linearly.

Figure 5:
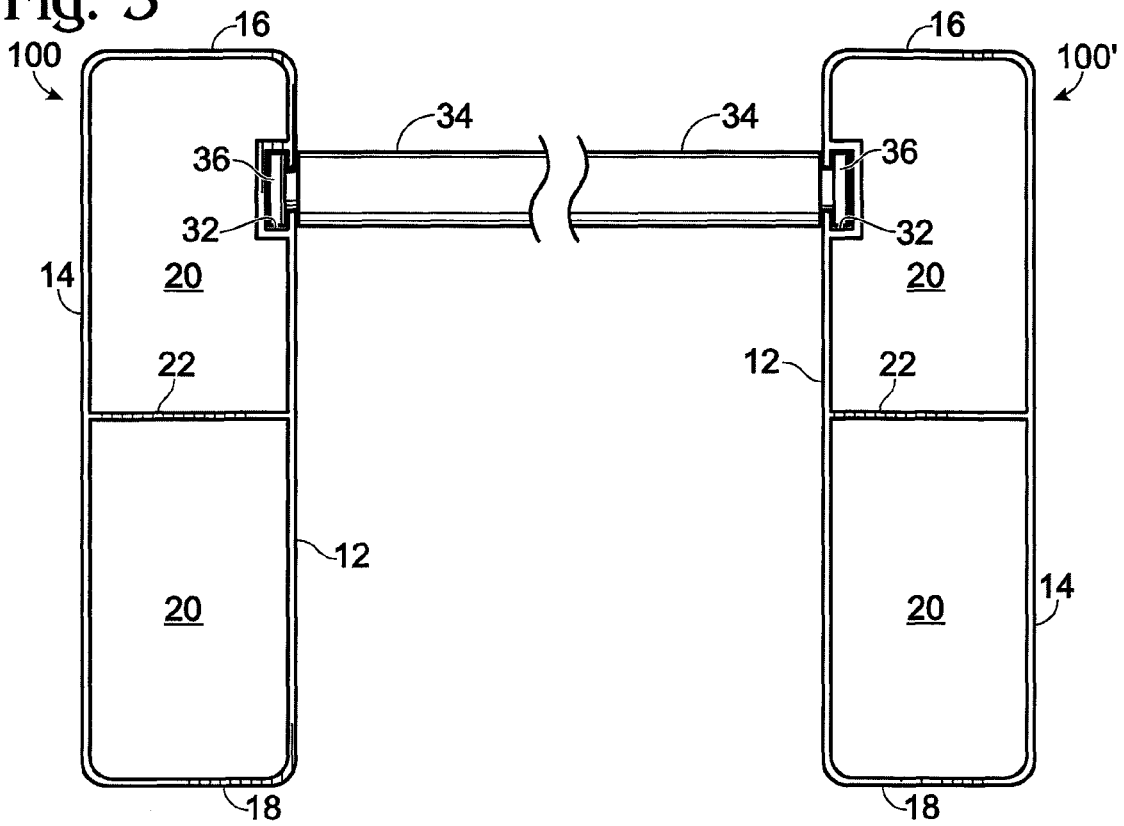
FIG. 5 is a side elevation view of a form spacing device separating an outer form drain segment from an inner form drain segment, with the form spacing device rotated into locking engagement with the form drain segments.
Figure 6:
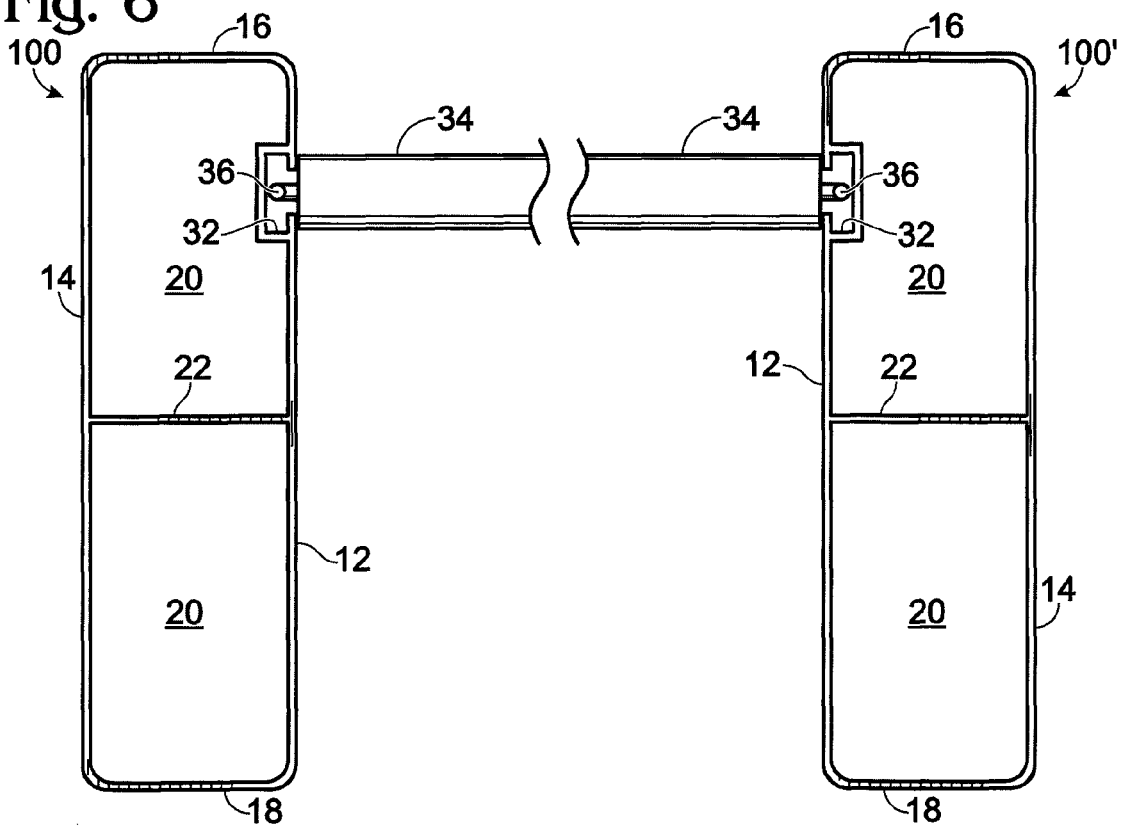
FIG. 6 is a side elevation view of a form spacing device separating an outer form drain segment from an inner form drain segment, with the form spacing device rotated to an unlocked position.

The form face 12 of form drain segment 10 is generally planar and does not include any drain perforations 24. The form face 12 of form-drain segment 10 has a generally smooth surface to form a smooth exterior surface on the foundation (not shown). The upper portion of form face 12 includes a T-channel 32 that extends the entire length of form drain segment 10 and is parallel to the top surface 16 and bottom surface 18. T-channel 32 is shaped to selectively engage an end of a form spacing device 34. Each end of form spacing device 34 includes an engagement fitting 36 for selectively but securely engaging the T-channel 32 of form drain segment 10. According to one embodiment of the invention, engagement fitting 36 is a cam shaped protrusion that can be inserted into T-channel 32, perpendicular to form face 12 (FIG. 6). When form spacing device 34 is rotated approximately 90 degrees, engagement fitting 36 is fixed in position in T-channel 32 (FIG. 5). The length of form spacing device 34 is selected based on the width of the foundation to be formed. It should be noted that a T-shape is the best mode currently known to the inventors, but channel 32 could be a variety of other shapes, such as triangular, Christmas tree-shaped, and the like.

Another aspect of channel 32 is that concrete and/or backfill material will infiltrate those portions of it not occupied by spacers 34. This infiltration produces an additional retention force that secures drain segments 10 in position.

In use, as shown in FIGS. 5 and 6, an exterior form 100 includes a plurality of form drain segments 10 that are connected to create the exterior portion of a foundation form, and an interior form 100' includes a plurality of drain segments 10 connected to form the interior portion of the foundation form. The exterior form 100 and interior form 100' are positioned such that the form face 12 of the form-drain segments 10 of the inner form 100' are positioned in facing relation to the form face 12 of the exterior form 100. In each form, the T-channel 32 is continuous adjacent the upper portion of the form. Form spacing devices 34 are positioned between the interior form and the exterior form and securely engage the T-channel 32 in each of the opposing form drain segments 10. After the form is properly positioned and the form spacing devices 32 are properly secured, uncured foundation material such as concrete can be poured between the opposing form faces 12 of the form drains 100 and 100' and allowed to cure. The form-drain segments 10 remain in place after the foundation material cures providing drainage of ground moisture away from the foundation.

What is claimed is:

1. A building foundation form system, comprising:

a. first and second form segments of predetermined length and adapted for positioning in laterally spaced, non-contacting, parallel relation to one another, and each having a form face, drain face, top surface and bottom surface all of which collectively define a hollow interior drain;

b. said form faces each including an indentation formed therein;

c. a spacer bar having first and second ends adapted to securely engage both of said indentations, thereby securely interconnecting said first and second form segments, wherein said spacer bar's first and second ends comprise first and second connecting lugs, respectively, said first and second connecting lugs comprising a generally T-shaped projection.

2. The form system of claim 1, further comprising a connector element for joining two of either of said first and second form segments in end-to-end relation and providing continuous drainage between said joined form elements.

3. The form system of claim 1, further comprising first and second stiffening members positioned within and extending co-axially with said first and second form segments, respectively.

4. The form system of claim 1, wherein said top surface is non-perforated.

5. The form system of claim 1, wherein said bottom surface is perforated.

6. The form system of claim 1, wherein said drain face is perforated.

7. The form system of claim 1, wherein said form face is non-perforated.

8. The form system of claim 1, wherein said indentations are elongated channels.

9. The form system of claim 8, wherein said elongated channels extend about the length of said segments.

10. The form system of claim 9, wherein said channels are T-shaped.

* * * * *